US007406804B2

(12) United States Patent
Den Daas

(10) Patent No.: US 7,406,804 B2
(45) Date of Patent: Aug. 5, 2008

(54) SYSTEM OF STACKABLE BLOCKS AS WELL AS BLOCK AND A JOINING ELEMENT OF THE SYSTEM

(76) Inventor: Gert J. Den Daas, Van der Gumsterlaan 15, Rozendaal (NL) NL-6891 EE ( * ) Notice: Subject to any disclaimer, the term of this patent is extended or adjusted under 35 U.S.C. 154(b) by 775 days.

(21) Appl. No.: 10/484,189

(22) PCT Filed: Jul. 18, 2002

(86) PCT No.: PCT/NL02/00483

§ 371 (c)(1),
(2), (4) Date: Jan. 16, 2004

(87) PCT Pub. No.: WO03/010396

PCT Pub. Date: Feb. 6, 2003

(65) Prior Publication Data

US 2004/0168393 A1 Sep. 2, 2004

(30) Foreign Application Priority Data

Jul. 19, 2001 (NL) ..... 1018589
Nov. 26, 2001 (NL) ..... 1019433
May 27, 2002 (NL) ..... 1020681

(51) Int. Cl.
*E04C 1/40* (2006.01)
*E04B 1/38* (2006.01)

(52) U.S. Cl. ..... 52/285.3; 52/605; 52/586.2; 52/513; 52/379; 405/286

(58) Field of Classification Search ..... 52/604, 52/605, 586.1, 586.2, 513, 379, 712, 565, 52/271, 284, 285.1, 285.2, 285.3, 285.4; 405/284, 286

See application file for complete search history.

(56) References Cited

U.S. PATENT DOCUMENTS 1,495,022 A * 5/1924 Langer ..... 52/293.2
2,228,363 A * 1/1941 Pinney ..... 52/580
2,423,695 A * 7/1947 Falco ..... 52/601
3,609,926 A * 10/1971 Muse ..... 52/439
3,680,277 A * 8/1972 Martin ..... 52/438
4,194,337 A 3/1980 Fischer
4,258,523 A * 3/1981 Waugh ..... 52/736.1

(Continued)

FOREIGN PATENT DOCUMENTS

DE 297 22 703 U1 11/1998
GB 981085 1/1965

OTHER PUBLICATIONS

English Abstract of DE 297 22 703 U1.

*Primary Examiner*—Brian Glessner
*Assistant Examiner*—Christopher J Darner
(74) *Attorney, Agent, or Firm*—Vista IP Law Group LLP

(57) ABSTRACT

A system consists of blocks (1) provided with grooves (19, 21) as well as joining elements (23) which are situated in the grooves for positioning the blocks with respect to each other. The block (1) has two joining sides (3, 5) for joining the blocks situated above and/or below it. Starting with a rough, undressed block, a layer of the rough block is removed from both joining sides over the whole surface, so that the joining sides (3, 5) become bearing surfaces (15, 17), which form the contact surfaces with the blocks above and below them. When dressing the rough block one makes sure that the distance (18) between the bearing surfaces (15, 17) lies within narrow tolerances of a desired value. Because of this, the blocks in a course lie precisely in a horizontal plane. The grooves (19, 21) and joining elements (23) make sure that the blocks lie precisely in a vertical plane. The joining element (23) is a profiled strip made of a flexible material having a width $W_1$ which is greater than the width $W_2$ of the grooves.

6 Claims, 4 Drawing Sheets

U.S. PATENT DOCUMENTS 4,383,396 A * 5/1983 Waugh ..... 52/40
4,661,023 A * 4/1987 Hilfiker ..... 405/262
4,834,584 A * 5/1989 Hilfiker ..... 405/262
D343,693 S * 1/1994 Jeffrey ..... D25/131
5,282,700 A * 2/1994 Rodrique ..... 405/284
5,485,703 A * 1/1996 Nordahl ..... 52/562
5,528,873 A * 6/1996 Correia et al. ..... 52/605
5,609,435 A * 3/1997 Nomura ..... 403/387
5,921,715 A * 7/1999 Rainey ..... 405/262
6,138,426 A * 10/2000 Mork et al. ..... 52/562
D438,648 S * 3/2001 Coulson ..... D25/132
6,792,731 B2 * 9/2004 Bott et al. ..... 52/603

* cited by examiner

SYSTEM OF STACKABLE BLOCKS AS WELL AS BLOCK AND A JOINING ELEMENT OF THE SYSTEM

This application is a National Stage Filing under 35 USC Section 371. This application claims priority under 35 USC Section 365 and any other applicable statutes, to International application Serial No. PCT/NL02/00483, filed Jul. 18, 2002, which claims priority to: 1) Dutch application Serial No. NL 2001 1018589 having a priority date of Jul. 19, 2001; and 2) Dutch application Serial No. NL 2001 1019433 having a priority date of Nov. 26, 2001; and 3) Dutch application Serial No. NL 2002 1020681 having a priority date of May 27, 2002. Each of the aforementioned applications is expressly incorporated herein by reference in their entireties.

BACKGROUND OF THE INVENTLON

1. Field of the Invention

The invention relates to a system of stackable blocks each of which has two joining sides, for joining to blocks situated above and/or below it, which joining sides are provided with bearing surfaces, which form the contact surfaces with the blocks situated above and/or below them, in which at least one of the joining sides is at least partially provided with a dressed area, which dressed area forms the bearing surface of this joining side, and in which this bearing surface is situated precisely at a desired distance from the opposite bearing surface of the same block.

By stackable blocks is meant blocks, which for the most part can be stacked without any adhesive between them in such a way that they make a wall, in which the blocks in a course are aligned horizontally and the different courses are aligned in a plane which, for example, is vertical or inclined.

2. Prior Art

A machine for producing blocks of such a system is known from GB-A-0.981.085. The block dressed using this machine is suitable for dry stacking. In order to make sure that the blocks when stacked in a course are aligned exactly and that the courses lie precisely in one plane and in order to obtain a bond between the courses of blocks situated on top of one another, the joining sides of the blocks produced in the known manner have a stepped shape, in which the top joining side of a block and the bottom joining side of a block above it fit together precisely. Therefore, with this system both the upper surfaces as well as the side surfaces of the stepped shape need to be dressed in a precise manner.

From DE 297 22 703 U a dry stackable building block is known which is provided with grooves for receiving joining elements. However this known building block is manufactured in a common way and is not dressed after its manufacture. Because of this the dimensions of this block are less accurate than the dressed blocks according to the invention and with the known blocks it is not possible to reach the same desired positioning accuracy as with the blocks according to the present invention.

SUMMARY OF THE INVENTION

An objective of the invention is to provide a system of the type described at the preamble for more simplified production and in which the blocks nevertheless can be positioned exactly with respect to each other. For this purpose, the system according to the invention is characterized in that there is at least one groove in each joining side which is opposite a groove in a joining side of a block situated above or below it, and that the system furthermore comprises joining elements situated in the grooves which are opposite each other. In order to achieve the desired positioning accuracy of the blocks in the different courses in a vertical direction, at least one joining side of the blocks is dressed. Because of this, the blocks have an exact dimension in a vertical direction. By using joining elements one can be sure that the blocks in a course are aligned.

Preferably, both joining sides are provided with a dressed area, in which the dressed areas extend practically over the whole surface of the joining sides and form the bearing surfaces.

An embodiment of the system according to the invention is characterized in that the joining elements are strips of a flexible material having a width which is greater than the width of the grooves. Because of this, the joining elements are prestressed in the grooves, as a result of which there can be no play between the blocks and the joining elements and as a result of which the blocks are kept in place with respect to each other.

A further embodiment of the system according to the invention is characterized in that the joining elements are profiled flexible strips having a width which is greater than the width of the grooves. The material of these joining elements does not have to be flexible, it is even preferable if it is not. In that case, the flexibility is provided by the shape of the material itself. Here as well, the joining elements in the grooves are prestressed, as a result of which there can be no play between the blocks and the joining elements and as a result of which the blocks are kept in place with respect to each other.

It is noted that the use of strips of a flexible material and/or profiled flexible strips having a width which is greater than the width of the grooves can also be applied to a system with blocks whose joining sides have not been dressed in the manner described for this purpose or even have not been dressed at all. For this reason, the possibility of protecting this embodiment independently is left open.

A further embodiment of the system is characterized in that the joining elements in cross section have at least roughly a waveform with at least two crests and a trough in which end segments are formed by the crests and a middle segment by the trough, and in which the middle segment is situated where the joining sides of two blocks stacked one on top of the other meet and is in contact with a side of the grooves opposite each other and the end segments are situated deep in the grooves and are in contact with the other sides of the grooves. Because the width of the joining element is greater than the width of the grooves, the end segments when mounted are bent flexibly with respect to the middle segment. Because of this, two blocks, situated one on top of the other, are positioned under tension with respect to each other.

A favourable embodiment of this is characterized in that the middle segment itself also has a waveform with a least two additional crests and one additional trough. In this way, a wall of each groove is in contact with one of the crests.

In order to make sure that the blocks with the joining sides lie on top of one another, the height of the joining elements is equal to or a little smaller than twice the depth of the grooves in the blocks.

In contrast to building a wall of blocks with cement, see for example U.S. Pat. No. 4,194,337, it is not possible to use wall ties without any problems when dry stacking blocks. Nevertheless, in order to be able to use wall ties still a further embodiment of the system according to the invention is characterized in that the system comprises wall ties and tie plates for joining the wall ties to the blocks, which wall ties are provided with a thread or parallel circumferential grooves at an outer end, and the tie plates are provided with an opening which extends from a side of the tie strip to a distance from the opposite side of the tie strip. The tie strip with the opening is situated over a wall tie and the wall of the opening is situated partially in the thread or the grooves of the wall tie.

Preferably, parts of the tie strip on both sides of the opening are bent in a width direction, and both parts are bent in opposite directions. In this way, the width of the tie strip is increased so that it is situated in the grooves with little or no play. In a further embodiment the tie strip has a width which is equal to or greater than the width of the grooves in the blocks. Because of this, the tie strip is situated in the grooves without any play or is even under tension in the grooves.

The invention also relates to a block and a joining element for application to the system according to the invention and to a wall of blocks which are dry stacked on top of one another and joining elements.

Furthermore, the invention relates to a method for stacking blocks with joining elements between them, each block of which is provided with two joining sides, for joining to blocks situated above and/or below it, in which each joining side is provided with at least one groove, and in which after laying a course of blocks, joining elements are placed in the grooves, after which a further course of blocks is laid with the grooves over the joining elements.

Blocks and joining elements suitable for stacking according to this method are known from U.S. Pat. No. 5,485,703. In this method, a very high degree of dimensional accuracy regarding the blocks and joining elements is required in order to stack the blocks without any play with respect to each other. In order to be able to stack the blocks more simply and cheaper without any play, the method according to the invention is characterized in that the joining elements are strips of a flexible material having a width which is greater than the width of the grooves, in which the joining elements are put under pressure in the grooves of a course of blocks and when the further course of blocks is laid the joining elements are also put under pressure in the grooves of that course.

An embodiment of the method according to the invention is characterized in that the joining elements are profiled flexible strips having a width greater than the width of the grooves, in which when laying a further course of blocks the joining elements are put under pressure in the grooves. In this way the joining elements can be placed first in the grooves of a course of blocks without any tension and only when a further course of blocks is laid are they put under tension.

In order to be able to use wall ties in the method as well, a further embodiment is characterized in that tie plates are placed in the grooves of a number of adjacent blocks, which tie plates are provided with an opening which extends from a side of the tie strip to a distance from the opposite side of the tie strip, and in which the tie plates with their openings are placed over the outer ends of wall ties provided with a thread or grooves.

BRIEF DESCRIPTION OF THE DRAWINGS

The invention will be elucidated more fully below by means of an example of an embodiment of the system according to the invention shove in the drawings. In these drawings.

DETAILED DESCRIPTION OF THE DRAWINGS

Figure 1:
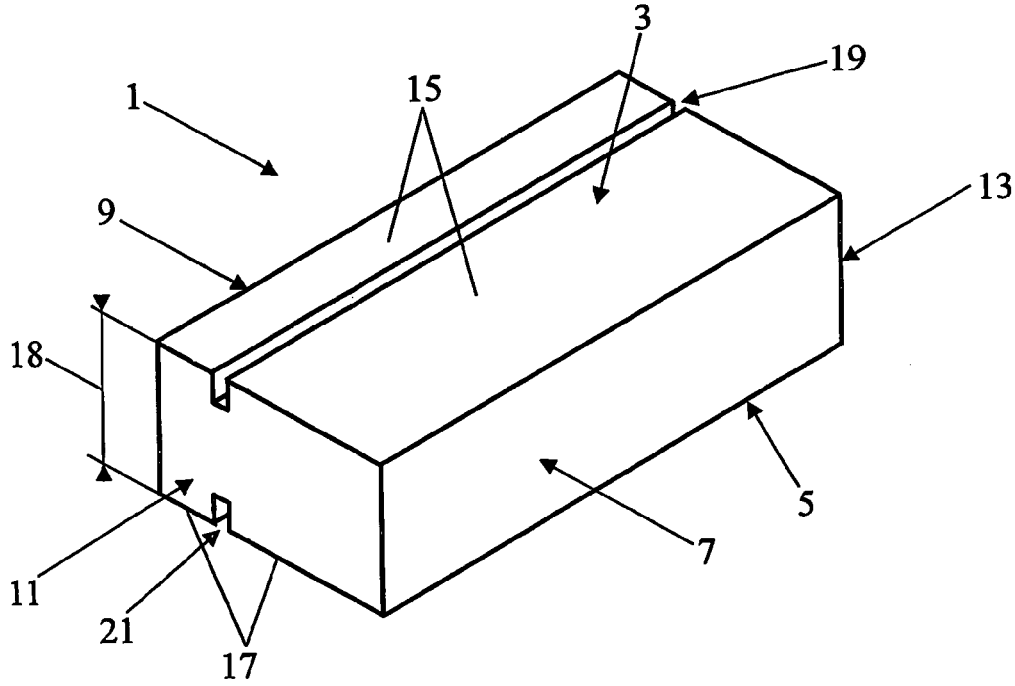
FIG. 1 shows an embodiment of a block of the system according to the invention in perspective.
Figure 2:
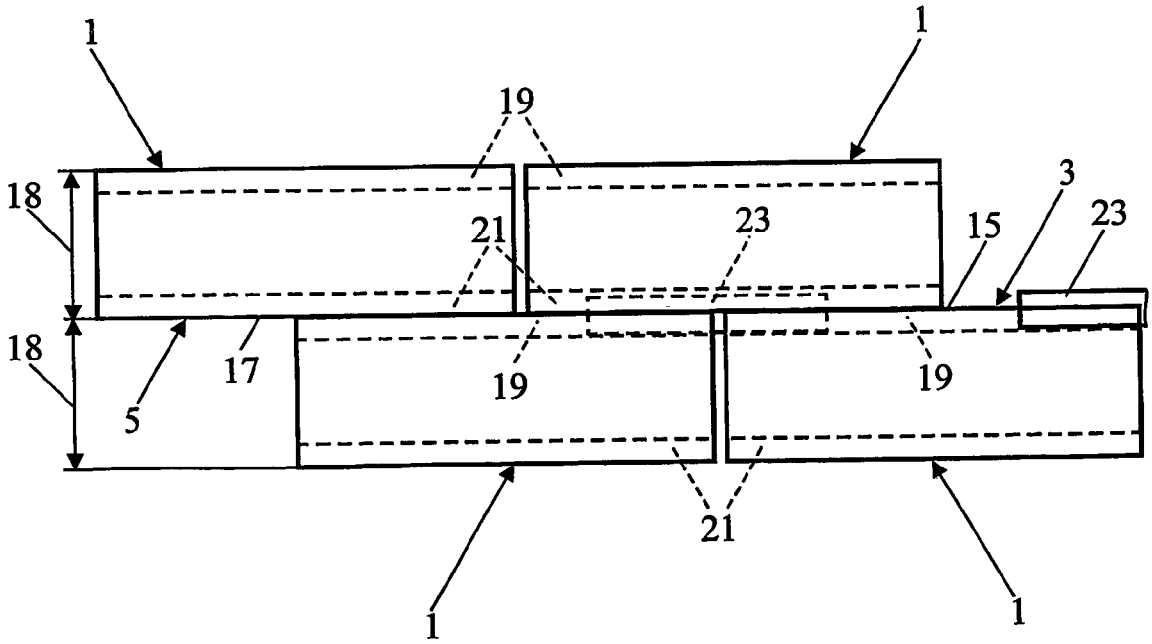
FIG. 2 shows a front view of an embodiment of the system according to the invention.
Figure 3:
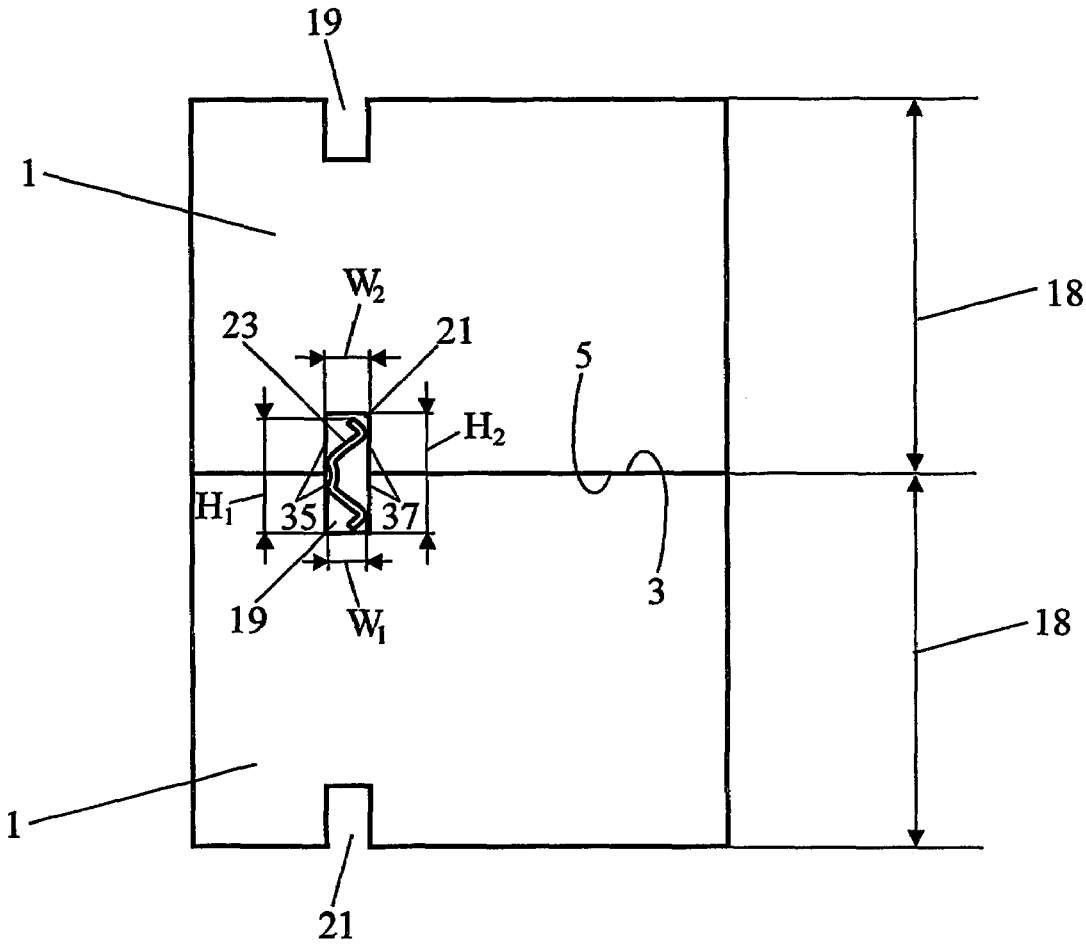
FIG. 3 shows a side view of the system shown in FIG. 2.

In FIG. 1 an embodiment of a block of the system according to the invention is shown and in FIG. 2 and 3 a first embodiment of the system according to the invention is shown in a front and side view respectively. The block 1 has two joining sides 3 and 5, for joining the block to blocks situated above and/or below it. Furthermore, the block 1 has a face 7 and a back 9, and two ends 11 and 13. Starting with a rough, undressed block, a layer of the rough block is removed from both joining sides over the whole surface, so that the joining sides 3, 5 form bearing surfaces 15, 17.

When dressing the rough block one makes sure that the distance 18 between the being surfaces 15 and 17 lies within narrow tolerances of a desired value. Because of this when the blocks are stacked, the blocks in a course lie precisely in one plane.

A groove 19, 21 is placed in each joining side 3, 5. These grooves are placed exactly at a previously determined distance from the face 7 of the block 1. By doing this one makes sure that the grooves 19 and 21 in the joining sides 3 and 5 are situated directly opposite each other. When stacking the blocks 1 the joining elements 23 are placed in the grooves 19, 21. The grooves 19, 21 and joining elements 23 make sure that when stacking the blocks they are precisely aligned in a vertical plane. Moreover, the joining elements 23 serve to prevent the blocks 1 from shifting in a direction transverse to the wall.

The joining element 23 is a profiled strip of a flexible material having a width $W_1$ which is greater than the width $W_2$ of the grooves (see FIG. 3). Furthermore, the joining element 23 is shorter than the length of one block and has a height $H_1$ which is smaller than the sum of the depth $H_2$ of groove 19 and the depth $H_2$ of the groove 21, so that the berg surfaces 15, 17 are always in contact with each other.

Figure 4:
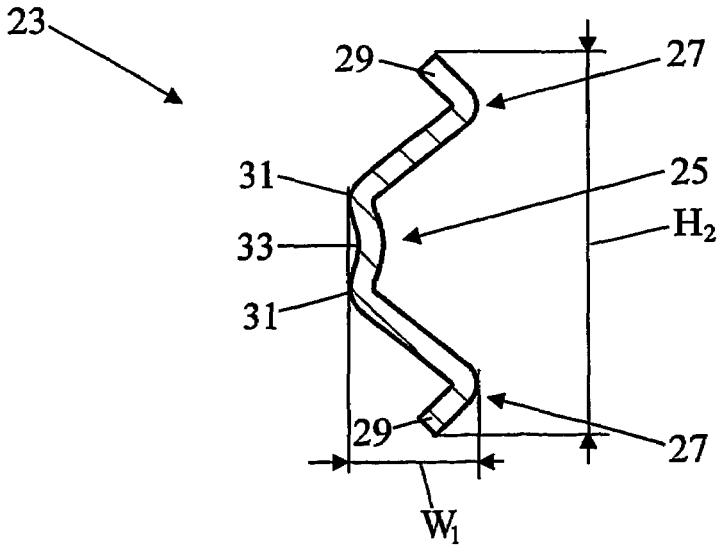
FIG. 4 shows a cross section of a first embodiment of the joining element of the system.

In FIG. 4 a cross section of the joining element 23 is shown. The joining element has, seen in cross section, a middle segment 25 and two end segments 27 which are bent downwards in the same direction as the middle segment. The joining element 23 has roughly a waveform with at least two crests and a trough in which the end segments 27 are the crests and the middle segment is the tough. The outer ends 29 of the end segments are bent downwards and the middle segment 23 itself also has a waveform with two additional crests 31 and one additional trough 33.

The middle segment 25 is situated where the joining sides 3 and 5 of two blocks 1 stacked one on top of the other meet and is in contact with a side 35 of the grooves 19 and 21 opposite each other. The end segments 27 are situated deep in the grooves 19 and 21 and are in contact with the other sides 37 of the grooves 19 and 21.

Figure 5:
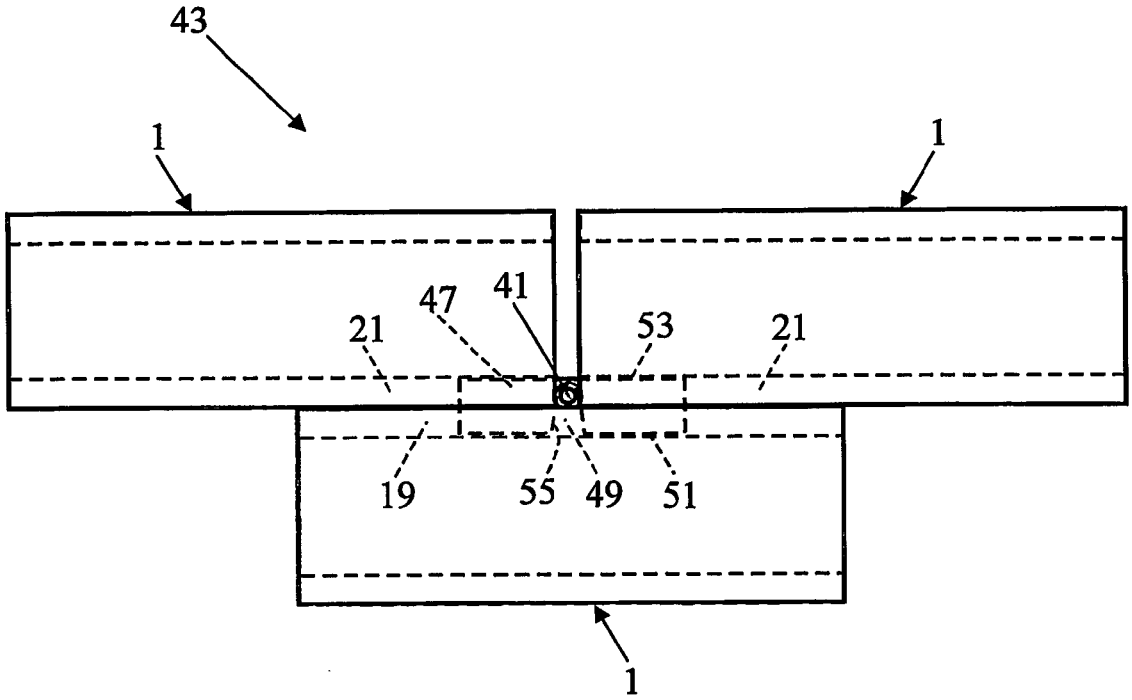
FIG. 5 shows a front view of the joining of a wall tie to a wall made of the blocks shown in FIG. 1.
Figure 6:
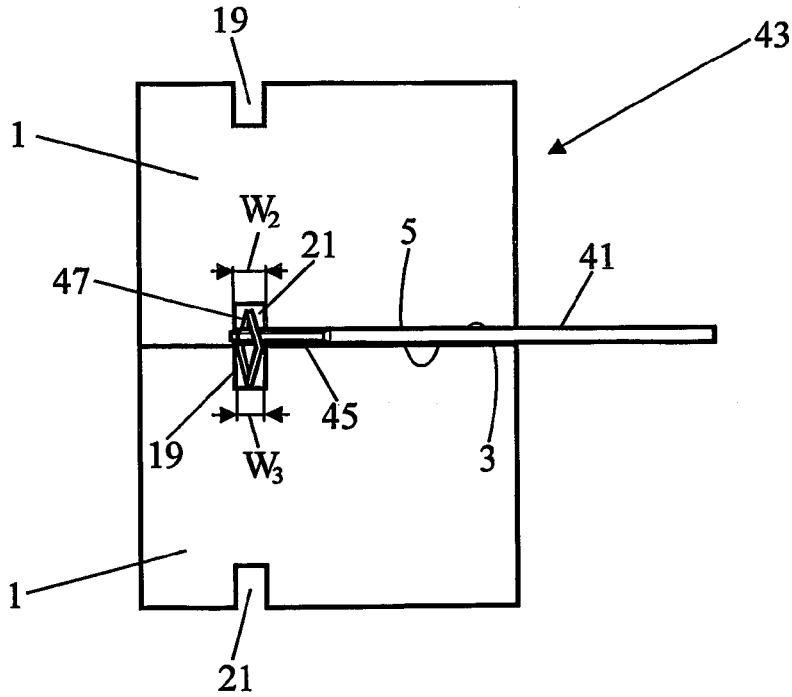
FIG. 6 shows a side view of the wall shown in FIG. 5.

Furthermore, the system has wall ties and tie plates for joining the wall ties to the blocks. In FIGS. 5 and 6 an embodiment of the joining of a wall tie 41 to a wall 43 is shown in a front and side view respectively. The wall 43 is built up of the blocks 1 and joining elements (not shown) of the system displayed in FIGS. 2 and 3.

The wall tie 41 is provided with a thread 45 at an outer end. The tie strip 47 is provided with an opening 49 which extends from a side 51 of the tie strip to a distance from the opposite side 53 of the tie strip. The tie strip 47 is situated with the opening 49 over the wall tie 41 and the wall 55 of the opening 49 is situated partially in the thread 45 of the wall tie 41.

Figure 7:
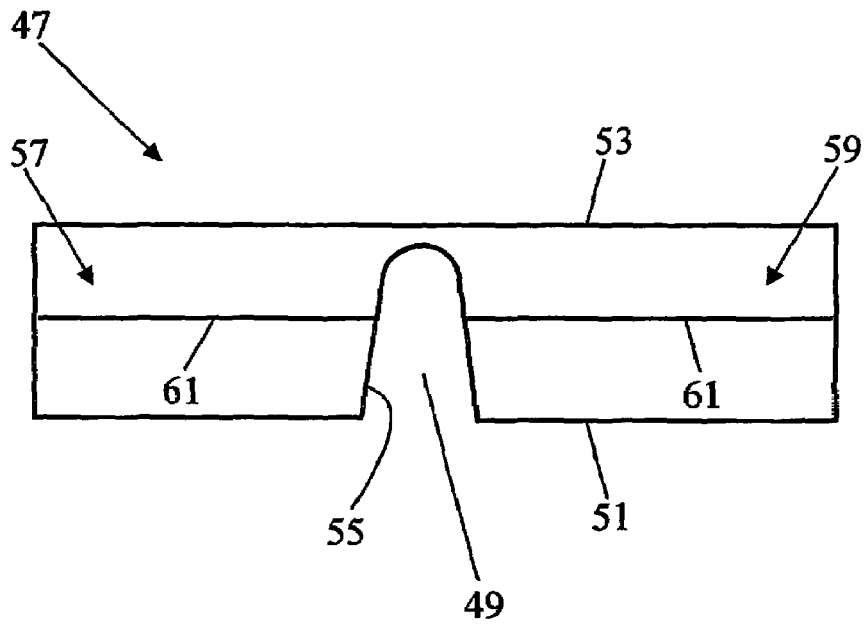
FIG. 7 shows a front view of a tie strip for joining a wall tie to the wall.
Figure 8:
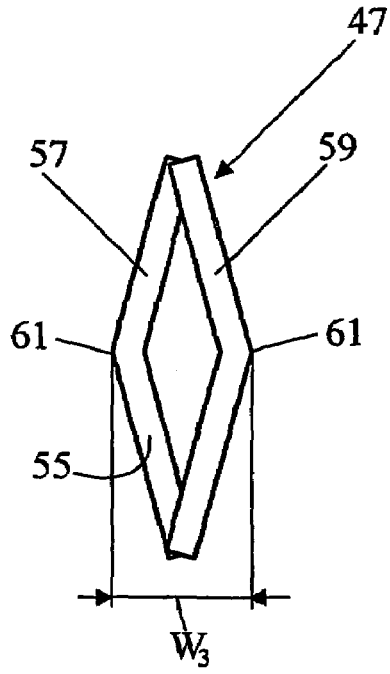
FIG. 8 shows a side view of the tie strip shown in FIG. 7.

In FIGS. 7 and 8 the tie strip 47 is shown in a front and side view respectively. Parts 57 and 59 of the tie strip 47 are bent along line 61 on both sides of the opening 49 in a vertical direction, and both parts 57, 59 are bent in opposite directions. The tie strip 47 has a width $W_3$ which is grater than the width $W_2$ of the grooves 19, 21 in the blocks 1 (see FIG. 6).

For stacking the blocks at a corner of a wall, special blocks can be made in which the groove does not extend along the full length of the block but stops at a distance from an end. By doing this, the groove cannot be seen from the visible end of the block at the corner.

Although the invention has been elucidated in the foregoing by means of the drawings, it should be established that the invention in no way is limited to the embodiment shown in the drawings. The invention also applies to all embodiments deviating from the embodiment shown in the drawings within the framework defined by the claims. Thus the profiling of the joining element may also extend transversely instead of in the longitudinal direction as shown above.

In addition, the grooves in the joining sides of a block do not have to be directly opposite each other, but may also be at a distance from each other transversely. This is desirable if the blocks are not horizontal in a wall, but have been stacked at an angle with respect to a horizontal plane.

Also instead of a profiled strip, a strip without a profile of a flexible material with for example, a rectangular cross section can be used, where the width of the strip is greater than or equal to the width of the grooves. In this case, the flexibility comes from the material and not the strip's shape.

Furthermore, instead of stacking the blocks dry, an adhesive, for example glue, can be applied between the blocks.

The invention claimed is:

1. System of stackable blocks each of which has two joining sides for joining to blocks situated above and/or below it, which joining sides are provided with bearing surfaces, which form the contact surfaces with blocks situated above and below them, in which at least one of the joining sides is at least partially provided with a dressed area, which dressed area forms the bearing surface of this joining side, and in which this bearing surface is situated exactly at a desired distance from the opposite bearing surface of the same block, characterized in that there is at least one groove in each joining side which is opposite a groove in a joining side of a block situated above or below it, and that the system furthermore comprises joining elements which are situated in the grooves opposite each other, wherein the joining elements are profiled flexible strips having a width ($W_1$) which is greater than the width ($W_2$) of the grooves, and the joining elements in cross section have at least roughly a waveform with at least two crests and a trough in which end segments are formed by the crests and a middle segment by the trough, and in which the middle segment is situated where the joining sides of two blocks stacked one on top of the other meet and is in contact with a side of the grooves opposite each other and the end segments are situated deep in the grooves and are in contact with the other sides of the grooves, and the middle segment itself also has a waveform with at least two additional crests and one additional trough.

2. System of stackable blocks each of which has two joining sides for joining to blocks situated above and/or below it, which joining sides are provided with bearing surfaces, which form the contact surfaces with blocks situated above and below them, in which at least one of the joining sides is at least partially provided with a dressed area, which dressed area forms the bearing surface of this joining side, and in which this bearing surface is situated exactly at a desired distance from the opposite bearing surface of the same block, characterized in that there is at least one groove in each joining side which is opposite a groove in a joining side of a block situated above or below it, and that the system furthermore comprises joining elements which are situated in the grooves opposite each other, and furthermore comprises wall ties and tie plates for joining the wall ties to the blocks, which wall ties are provided with a thread or parallel circumferential grooves, and which tie plates are provided with an opening which extends from a side of the tie plate to a distance from the opposite side of the tie plate, and in which the tie plate with the opening is situated over a wall tie and the wall of the opening is situated partially in the thread or the grooves of the wall tie.

3. System according to claim 2, characterized in that parts of the tie plate on both sides of the opening are bent in the width direction and both parts are bent in opposite directions.

4. System according to claim 3, characterized in that the tie plate has a width ($W_3$) which is equal to or greater than the width ($W_2$) of the grooves in the blocks.

5. Wall of blocks stacked one on top of the other and joining elements, each block of which has two joining sides, for joining to blocks situated above and/or below it, in which there is at least one groove in each joining side, and in which the joining elements are situated in the grooves, characterized in that the joining elements are profiled strips of a flexible material having a width ($W_1$) which is greater than the width ($W_2$) of the grooves and that the joining elements situated in the grooves are under pressure, and further characterized in that tie plates are situated in the grooves of a number of adjacent blocks, which tie plates are provided with an opening which extends from a side of the tie plate to a distance from the opposite side of the tie plate, in which the opening is situated where the two outer ends of the adjacent blocks are situated, and in which an outer end of a wall tie provided with a thread or parallel grooves is situated in the opening.

6. Method for stacking blocks with joining elements between them, each block of which is provided with two joining sides, for joining to blocks situated above and/or below it, in which each joining side is provided with at least one groove, and in which after laying a course of blocks, joining elements are placed free of tension in the grooves, after which a further course of blocks is laid with the grooves over the joining elements, characterized in that the joining elements are profiled flexible strips having a width ($W_1$) greater than the width ($W_2$) of the grooves, in which when laying a further course of blocks the joining elements are put under pressure in the grooves, and further characterized in that tie plates are placed in the grooves of a number of adjacent blocks, which tie plates are provided with an opening which extends from a side of the tie plate to a distance from the opposite side of the tie plate, in which the tie plates with their openings are placed over the outer ends of wall ties provided with a thread or groove.

* * * * *